US005620370A

United States Patent [19]

Umai et al.

[11] Patent Number: 5,620,370

[45] Date of Patent: Apr. 15, 1997

[54] BLOWING APPARATUS, SUCTION PANEL THEREFOR AND STRAIGHTENING GUIDE THEREFOR

[75] Inventors: Yoshiyuki Umai; Yoshikatsu Nankaku; Keiichi Hasegawa; Yoshimi Iwamura, all of Gifu; Katsuhisa Ootsuta, Hyogo; Kiyoshi Nakamura, Gifu, all of Japan

[73] Assignee: Mitsubishi Denki Kabushiki Kaisha, Tokyo, Japan

[21] Appl. No.: 268,980

[22] Filed: Jun. 30, 1994

[30] Foreign Application Priority Data

Dec. 2, 1993 [JP] Japan ..... 5-302950

[51] Int. Cl.[6] ..... F24F 7/007

[52] U.S. Cl. ..... 454/354; 181/225

[58] Field of Search ..... 181/225; 454/341, 454/346, 349, 354, 906

[56] References Cited

U.S. PATENT DOCUMENTS

| | | | |
|---|---|---|---|
| 2,134,142 | 10/1938 | Orear | 454/354 X |
| 2,739,521 | 3/1956 | Spear | 454/349 |
| 3,011,423 | 12/1961 | Breidert | 454/346 X |
| 3,330,379 | 7/1967 | Cook | 454/906 X |
| 3,949,830 | 4/1976 | Muehlbauer et al. . | |
| 4,750,860 | 6/1988 | Kelley . | |
| 4,787,818 | 11/1988 | Bales et al. . | |
| 5,208,730 | 5/1993 | Tracy . | |
| 5,259,726 | 11/1993 | Bacria . | |
| 5,326,317 | 7/1994 | Ishizu et al. | 454/354 |

FOREIGN PATENT DOCUMENTS

| | | | |
|---|---|---|---|
| 146450 | 11/1979 | Japan | 454/354 |
| 59-49827 | 4/1984 | Japan . | |
| 2-538 | 1/1990 | Japan . | |
| 144240 | 6/1991 | Japan | 454/341 |
| 4-113843 | 10/1992 | Japan . | |
| 1176053 | 1/1970 | United Kingdom . | |
| 1247761 | 9/1971 | United Kingdom | 454/338 |
| 1511625 | 5/1978 | United Kingdom . | |
| 2062758 | 5/1981 | United Kingdom . | |
| 2263502 | 7/1993 | United Kingdom . | |

*Primary Examiner*—Harold Joyce

[57] ABSTRACT

A blowing apparatus includes a suction passage having a suction chamber enclosed by rigid body surfaces, suction ports opening toward the suction chamber for sucking air from outside, and a fan suction port serving as a suction port for a blower, the suction ports, the suction chamber, and the fan suction port being arranged in nonlinear form. In such blowing apparatus, a doughnut-like straightening guide is arranged on an opening edge on the suction chamber side of the fan suction port. The straightening guide has a projection toward the suction chamber, an appropriate thickness in the radial direction, and a guide passage matching the fan suction port in the middle thereof.

37 Claims, 10 Drawing Sheets

BLOWING APPARATUS, SUCTION PANEL THEREFOR AND STRAIGHTENING GUIDE THEREFOR

BACKGROUND OF THE INVENTION

1. Field of the Invention

This invention relates to a blowing apparatus whose suction passage is not linear, to a suction panel thereof, and to a straightening guide thereof.

2. Discussion of the Related Art

In some blowing apparatuses such as ventilating fans and ventilating systems, the suction passage extending from the suction port to the fan suction port of the blower is not linear. That is, the suction port is disposed at a position out of the front of the suction port so that the inner structure of, e.g., the blower cannot be seen from the suction port. The suction port is generally formed at a suction panel that constitutes the front of the blowing apparatus. The suction panel itself tends to be flat in structure to improve the design of the blowing apparatus.

Blowing apparatuses of this type are disclosed by, e.g., Japanese Utility Model Unexamined Publications Nos. Hei 4-113843, Hei 2-538, and Sho 59-49827. Each of these apparatuses has such a basic structure as shown in FIG. 17. In FIG. 17, a main body frame 1 that is of a rectangular box type with one open surface is divided into two sections, a suction chamber 4 and a blower chamber 5, by an opening 2 and a suction partition 3 that extends in parallel with the opening 2. A motor 6 is mounted substantially in the middle of a surface of the main body frame 1 which is opposed to the opening 2. A multiblade fan 7 is attached to the rotary shaft of the motor 6. The multiblade fan 7 rotates inside the blower chamber 5. Substantially in the middle of the suction partition 3 is a fan suction port 8, which is not only circular so as to be coaxial with the multiblade fan 7 but also bell-mouthed. The fan suction port 8 is open to the suction chamber 4. Further, a blowout port 10 communicating with a blowout passage 9 is formed in one side of the blower chamber 5. A piping member 11 installed in the ceiling is connected to the blowout port 10.

The main body frame 1 is fixed so that the opening 2 is generally flush with the ceiling surface of the ceiling plate. A suction panel 12 is attached to the opening 2, which faces the ceiling surface, by a fastening means such as a spring so as to close the opening 2. The suction panel 12 has slit-like suction ports 13 formed in the vicinity of the outer edge portions thereof that do not confront the fan suction port The slit-like suction ports 13 communicate with the suction chamber 4 and extend along the four sides or two opposing sides of the suction panel 12. Therefore, the front of the fan suction port 8 is concealed by a front panel portion 14 of the suction panel 12 so as not to be seen from outside. The suction chamber 4 is formed of a space enclosed by the rigid body surfaces including the inner peripheral surfaces of the main body frame 1, the suction partition 3, and the suction panel 12, and constitutes a suction passage 15 that extends from the suction ports 13 to the fan suction port 8 via the suction chamber 4 in nonlinear form.

Since the main body frame 1 and the suction chamber 4 usually must have an appropriate area as a suction passage or blowout passage, the sectional area thereof is set to a value about 3 to 6 times the opening area of the fan suction port 8. If the height of the suction chamber 4 (H in FIG. 17) is too small, the suction chamber 4 is subjected to pressure losses and cannot absorb the inertia of a rapid stream from the suction ports 13, thus having difficulty turning the stream toward the fan suction port 8. Hence, the height is set to a value at least about 30 to 60% the diameter of the fan suction port 8. On the other hand, the area of opening of the suction ports 13 is set to a value as small as possible so that design requirements can be met. The area is set to a value approximately equal to or up to twice the area of opening of the fan suction port 8. Therefore, the suction passage 15 extending from the suction ports 13 to the fan suction port 8 via the suction chamber 4 expands suddenly at the suction chamber 4 from the narrow suction ports 13, and then narrows again at the fan suction port 8, making itself nonlinear.

Also, another type of blowing apparatus is disclosed in Japanese Patent Unexamined Publication No. Hei 5-126378. As indicated by the chain line in FIG. 17, an umbrella-like guide member 16 made of a noise insulating material is provided on the back of the suction panel 12, so that not only the stream to the fan suction port 8 can be guided, but also fan noise propagated from the fan suction port 8 to the front panel portion 14 can be reduced.

A blowing apparatus having the similarly nonlinear suction passage 15 from the suction ports 13 to the fan suction port 8 via the suction chamber 4 is disclosed in Japanese Utility Model Unexamined Publication No. Hei 1-125897. This blowing apparatus is constructed, as shown in FIG. 18, so that the main body frame 1 is of a box type having no opening. The suction port 13 that is connected to the piping member 11 is formed on a side opposite to the blowout port 10. Therefore, there is no suction panel, and the suction chamber 4 is formed into an L-shaped space enclosed by the inner peripheral and bottom surfaces of the main body frame 1 and the outer surface of the blower chamber 5. The suction passage 15 suddenly expands at the wide suction chamber 4 from the narrow suction port 13 and narrows again at the fan suction port 8, similarly making itself nonlinear.

Any of the above-mentioned blowing apparatuses sucks air from the suction port or ports 13 to the fan suction port 8 via the suction chamber 4 by the rotation of the motor 6. At this time, the rapid stream introduced from the narrow suction port or ports 13 is decelerated upon entrance into the suction chamber 4, having the inertial effect thereof lessened. Therefore, the flow of the stream becomes dependent on the sucking force produced at the fan suction port 8, leaving itself sucked into the fan suction port 8.

In the conventional blowing apparati thus constructed, the suction chamber 4 shown in FIG. 17 expands suddenly and, therefore, the stream introduced into the suction chamber 4 is not decelerated uniformly, but flows while picking up air within the suction chamber 4. As a result, the direction of the stream is not steady, which eventually makes the stream extremely disturbed as shown by the arrows in FIG. 17. Such disturbed stream is converged at the fan suction port 8 within a short range in the floating direction, leaving the stream running into the multiblade fan 7 in an unstraightened condition, thus, aggravating the turbulence of the stream in the multiblade fan 7. This results in large fan noise. Further, the umbrella-like guide member 16 straightens the stream on the suction side to some degree, but the straightened stream is such that only some parts of the multiblade fan 7 can function, thus impairing blowing efficiency. In addition, the level of noise insulation is not more than what is implemented by the guide member 16.

Because the suction chamber 4, including the blowout passage 9 is enclosed by rigid body surfaces, repetitive reflections of sound waves of noises echo between opposing rigid body surfaces, the causing a standing wave (which is a sound whose frequency is determined by the form and size of the chamber, i.e., resonance). Since the fan noise that becomes a source for causing resonance is so large, as described above, the resonance is also large. FIG. 19 shows the frequency spectra of the noise produced by the blowing apparatus shown in FIG. 17. An high-level acoustic resonance is generated at 500 Hz and 1 kHz, and a low-level acoustic resonance is generated between 2 and 3 kHz.

The above-mentioned problem is addressed likewise in the blowing apparatus shown in FIG. 18 in which the flow passage of the suction chamber 4 is relatively long. However, the blowing apparatus shown in FIG. 18 is characterized in that the suction chamber 4 has a right-angled corner and there is only one suction port 13 which is unevenly distributed in one direction with respect to the fan suction port 8. These factors contribute to increasing the turbulence of the stream in the suction chamber 4 and aggravating the stream flowing into the multiblade fan 7.

SUMMARY OF THE INVENTION

The present invention has been made to overcome the above-mentioned conventional problems. Accordingly, an object of the invention is to achieve noise reduction by substantially decreasing the turbulence of a stream flowing into a blower.

Another object of the invention is to decrease the level of resonance without impairing blowing efficiency.

Still another object of the invention is to reduce noise of the blowing apparatus with a simple arrangement.

A first aspect of the invention is applied to a blowing apparatus in which suction ports and a fan suction port open toward a suction chamber enclosed by rigid body surfaces and in which a suction passage formed of these three parts is arranged in nonlinear form. In such a blowing apparatus, a straightening guide is provided at an opening edge of the fan suction port on the suction chamber side. The straightening guide is of such a doughnut-like shape as to have a guide passage at the center thereof with a projection toward the suction chamber and an appropriate thickness in the radial direction, the guide passage matching the fan suction port.

A second aspect of the invention is applied to a blowing apparatus, wherein a constricting section formed of a curved inner surface is provided in the middle of the guide passage of the straightening guide according to the first aspect of the invention, and the inner diameter of the guide passage is gradually increased from the constricting section toward the fan suction port.

A third aspect of the invention is applied to a blowing apparatus, wherein the straightening guide according to the first or second aspect of the invention is formed of a hollow body; a noise absorbing member is filled in the hollow body; and a back side of the noise absorbing member is caused to communicate with a blowout side of the blower by an air introducing section.

A fourth aspect of the invention is applied to a blowing apparatus, wherein the straightening guide according to the first or second aspect of the invention is formed of a hollow body; a noise absorbing member is filled in the hollow body by forming a back air space on the suction chamber side of the hollow body; and a side opposite to the back air space side of the noise absorbing member is caused to communicate with a blowout side of the blower by an air introducing section.

A fifth aspect of the invention is applied to a suction panel that is applied to a blowing apparatus, the blowing apparatus comprising: a suction chamber being enclosed by rigid body surfaces with one open surf ace; and a fan suction port serving as a suction port for a blower, the fan suction port opening toward a surface opposite to the open surface of the suction chamber, the suction panel being attached to the blowing apparatus so as to close the open surface. The suction panel comprises a panel base body for allowing the open surface to be closed, the panel base body including: first suction ports, each being slit-like, opening so as to enclose the outer periphery of fan suction port, and communicating with the suction chamber; and second suction ports, each being slit-like, opening outside the first suction ports distant from the first suction ports by an opening width or more of the first suction ports so as to enclose the first suction ports, and communicating with the suction chamber.

A sixth aspect of the invention is applied to a suction panel that is applied to a blowing apparatus, the blowing apparatus comprising: a suction chamber being enclosed by rigid body surfaces with one open surface; and a fan suction port serving as a suction port for a blower, the fan suction port opening toward a surface opposite to the open surface of the suction chamber, the suction panel being attached to the blowing apparatus so as to close the open surface. The suction panel comprises a panel base body for allowing the open surface to be closed, the panel base body including: first suction ports, each being slit-like, opening so as to enclose the fan suction port, and communicating with the suction chamber; and second suction ports, each being slit-like, opening outside the first suction ports distant from the first suction ports by an opening width or more of the first suction ports so as to enclose the first suction ports, and communicating with the suction chamber. In such suction panel, opening ends of the first suction ports on the suction chamber side open toward the fan suction port.

A seventh aspect of the invention is applied to a blowing apparatus, wherein the suction chamber according to the first aspect of the invention has one surface with an opening and other surfaces thereof which are enclosed by rigid body surfaces, and the one surface of the suction chamber is formed of a suction panel having first and second suction ports, the first suction ports being slit-like, opening so as to enclose a fan suction port opening toward a surface of the suction chamber opposite to the one surface, and communicating with the suction chamber, the second suction ports being slit-like, opening outside the first suction ports distant from the first suction ports by an opening width or more of the first suction ports so as to enclose the first suction ports, and communicating with the suction chamber.

An eighth aspect of the invention is applied to a straightening guide for a blowing apparatus, the blowing apparatus comprising a suction passage including: a suction chamber enclosed by rigid body surfaces; suction ports respectively opening toward the suction chamber for sucking air from outside; and a fan suction port serving as a suction port for a blower, the suction ports, the suction chamber, and the fan suction port being arranged in nonlinear form, the straightening guide being attached to an opening edge of the fan suction port on the suction chamber side of the blowing apparatus. The straightening guide is formed of a doughnut-like hollow body or a doughnut-like solid body having a guide passage at the center thereof with a projection toward the suction chamber and an appropriate thickness in the radial direction, the guide passage matching the fan suction port, the whole or a part of the doughnut-like hollow body being formed of a porous material, or the whole of the doughnut-like solid body being formed of a noise absorbing member.

According to the first aspect of the invention, the air is sucked into the fan suction port from the suction ports via the suction chamber, and flows into the suction chamber on the outer circumferential side of the straightening guide, where the stream is decelerated due to the sudden expansion of the suction passage, so that the stream becomes dependent on the sucking force produced at the fan suction port. The stream then passes through the contracted section formed by both the projection of the straightening guide and the thickness thereof in the radial direction to become a less disturbed stream, and is sucked into the guide passage of the straightening guide in the less disturbed conditions up to the fan suction port. Since the stream is given an approach by the guide passage, the stream is straightened into a substantially uniform stream, thus a less turbulent and uniform stream to blower. No opposing surfaces are formed in the suction chamber by the rigid body surfaces of the main body frame owing to the projection of the outer circumferential surface of the straightening guide.

In addition to the mode of operation mentioned with respect to the first aspect of the invention, according to the second aspect of the invention, the stream that enters into the guide passage is moderately constricted as the stream flows toward the constricting section in the middle and then is expanded in the radial direction toward the fan suction port.

In addition to the mode of operation mentioned with respect to the first or second aspect of the invention, in the means according to the third aspect of the invention, the blowout noise of the blower is damped by the noise absorbing member filled in the straightening guide through the air introducing section.

In addition to the mode of operation of the first or second aspect of the invention, according to the fourth aspect of the invention, noise frequencies to be reduced can be adjusted by changing the distribution of space between the noise absorbing member filled in the straightening guide through the air introducing section and the back air space.

According to the fifth aspect of the invention, the rapid stream introduced from the second suction ports is drastically decelerated due to the sudden expansion of the rapid stream upon entrance into the suction chamber with the inertia of the rapid stream being mitigated and, therefore, tends to become unstable and dependent on the sucking force produced at the fan suction port. However, since the stream is induced toward the fan suction port by the stream from the first suction ports, the direction of the stream in the entire part of the suction chamber becomes stable.

According to the sixth aspect of the invention, the rapid stream introduced from the second suction ports is drastically decelerated due to the sudden expansion of the rapid stream upon entrance into the suction chamber with the inertia of the rapid stream being mitigated and, therefore, tends to become unstable and dependent on the sucking force produced at the fan suction port. However, since such stream is induced by the stream from the first suction ports which is flowing toward the center, the stream from the second suction ports is induced and turned toward the fan suction port, which makes the direction of the stream in the entire part of the suction chamber more stable.

According to the seventh aspect of the invention, the mode of operation mentioned with respect to the fifth aspect of the invention is superposed upon the mode of operation mentioned with respect to the first aspect of the invention.

According to the eighth aspect of the invention, the stream from the suction ports to the fan suction port can be straightened into a substantially uniform stream by only applying the invention to the blowing apparatus in which the suction ports and the fan suction port open toward the suction chamber which is enclosed by the rigid surfaces and the nonlinear suction passage is formed of these three parts. Further, noise can be reduced by the noise absorbing member.

The above and further objects, features and advantages of the invention will appear more fully from the accompanying drawings and the following detailed description.

DETAILED DESCRIPTION OF THE PREFERRED EMBODIMENTS (Embodiment 1)

Figure 1:
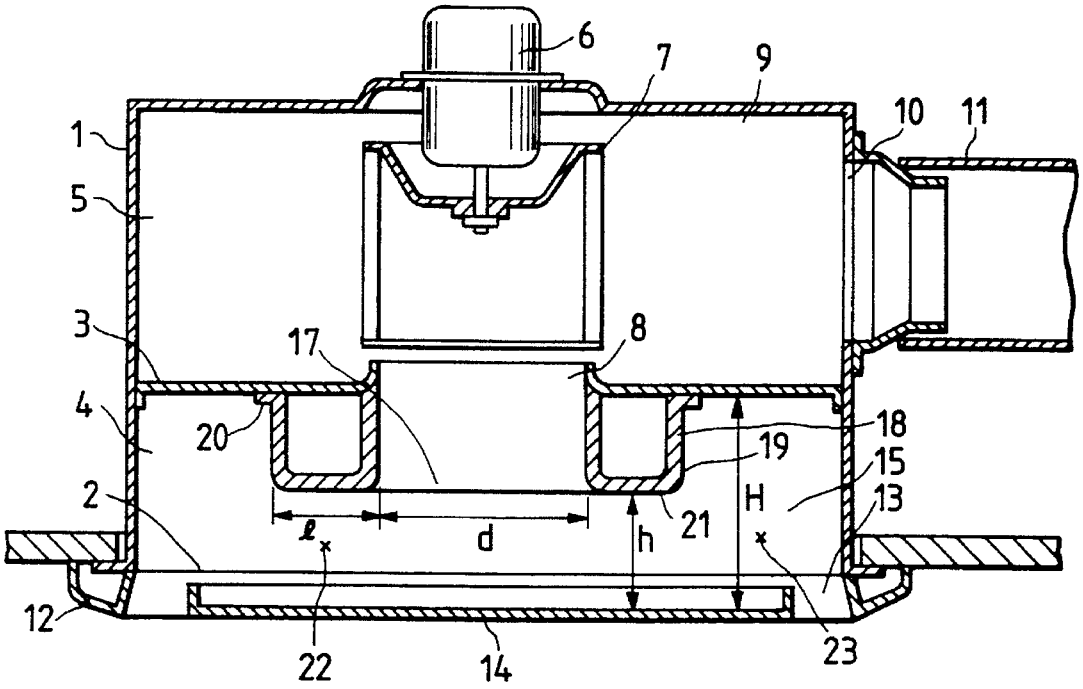
FIG. 1 is a longitudinal sectional view of a blowing apparatus according to Embodiment 1 of the invention.
Figure 2:
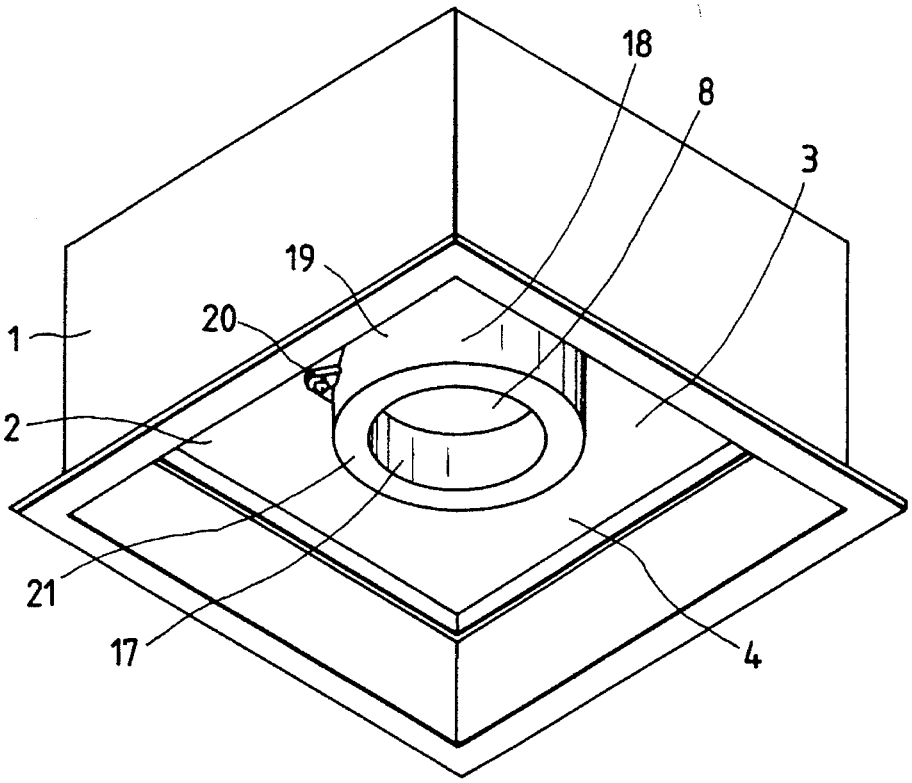
FIG. 2 is a perspective view of the main portion of the blowing apparatus of FIG. 1.
Figure 3:
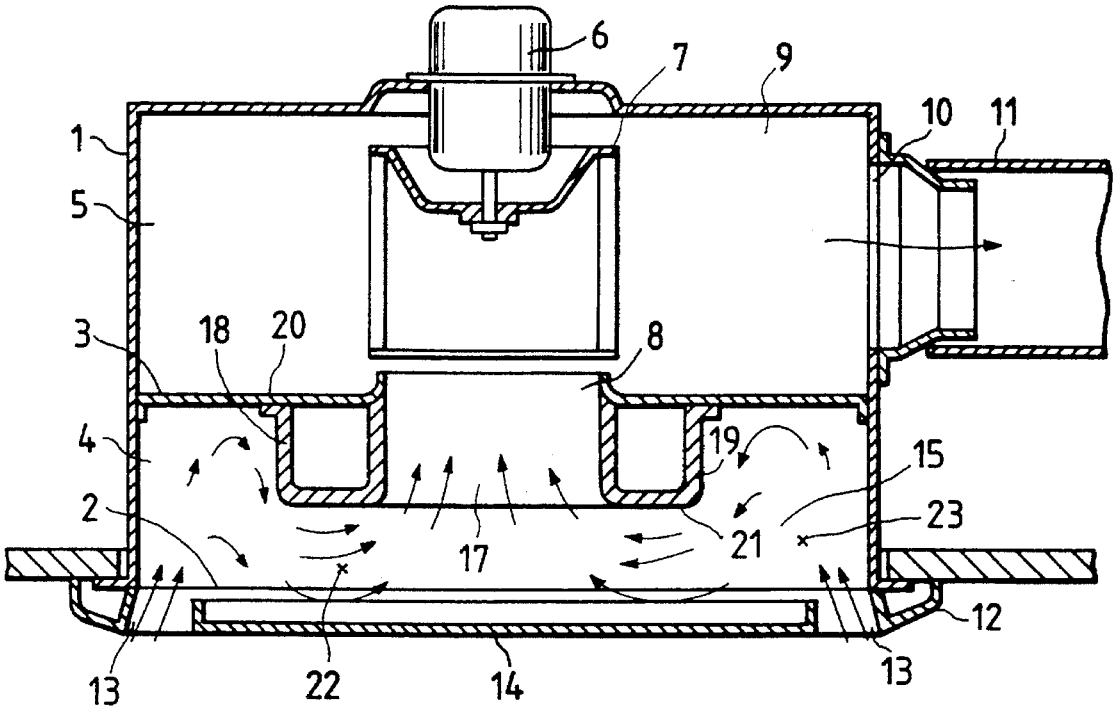
FIG. 3 is a longitudinal sectional view showing the function of the blowing apparatus of FIG. 1.
Figure 17:
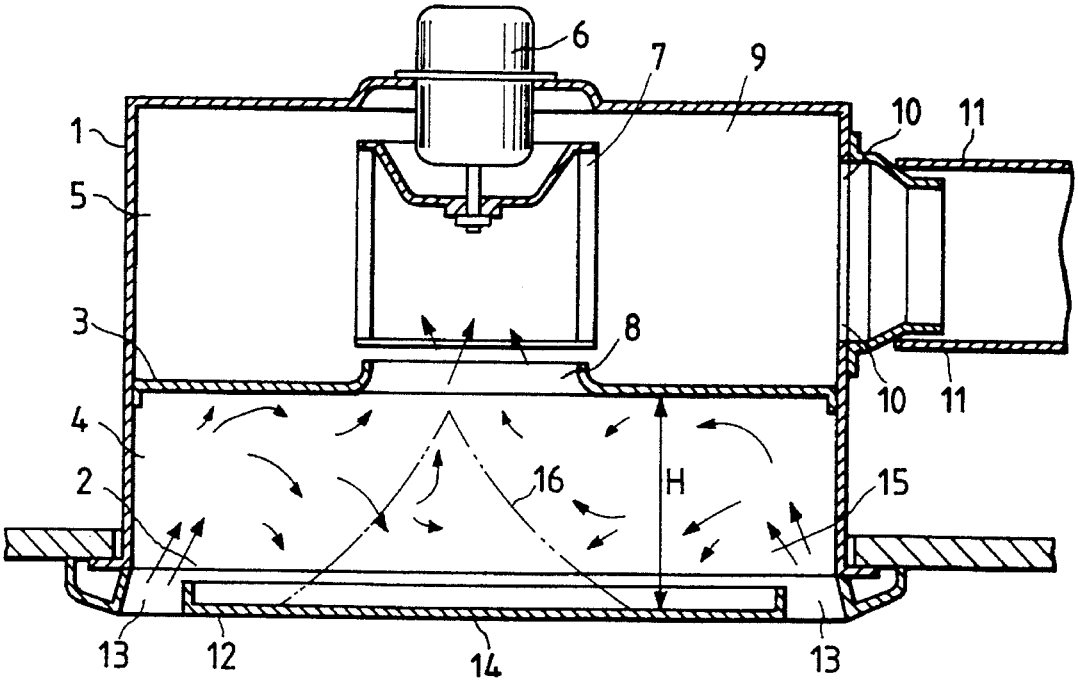
FIG. 17 PRIOR ART
FIG. 17 is a longitudinal sectional view of one conventional blowing apparatus.
Figure 18:
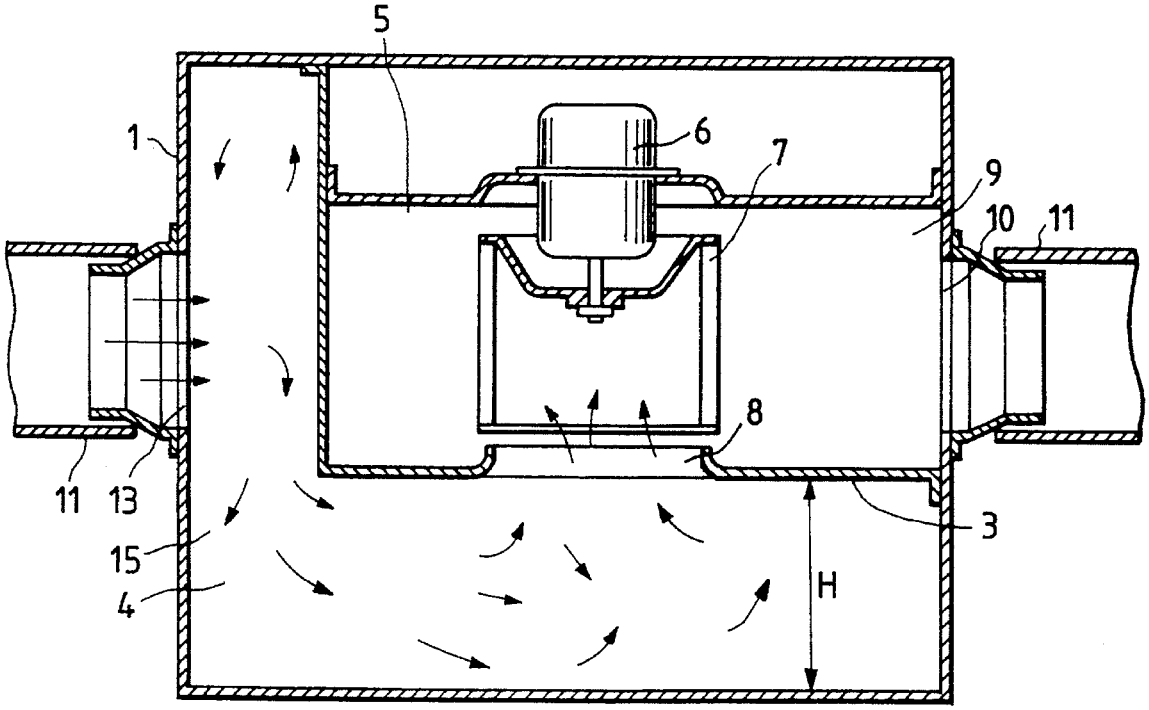
FIG. 18 PRIOR ART
FIG. 18 is a longitudinal sectional view of another conventional blowing apparatus.
Figure 19:
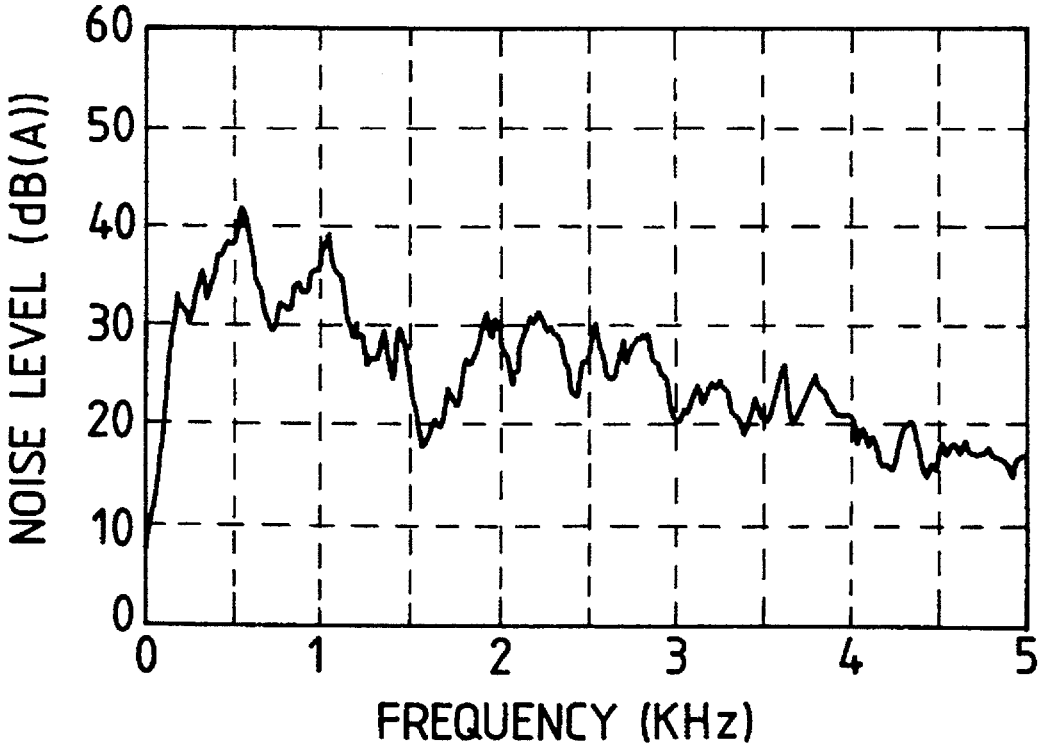
FIG. 19 PRIOR ART
FIG. 19 is a frequency spectra graph illustrative of the noise produced by the conventional blowing apparatus.

FIG. 1 is a longitudinal sectional view of a blowing apparatus, which is Embodiment 1 of the invention; FIG. 2 is a perspective view of the main portion thereof; and FIG. 3 is a longitudinal sectional view showing the function of the blowing apparatus. As is understood from these figures, the basic structure of the blowing apparatus itself is the same as that of the conventional example shown in FIG. 17. Therefore, the same parts and components as those of the conventional example are designated by the same reference numerals, and the detailed description thereof will be omitted.

In FIG. 1, a rectangular box-shaped main body frame 1 having an opening at the bottom thereof has a blower assembled thereto, and is mounted on the ceiling surface of a ceiling plate in such a manner that the opening 2 is generally flush with the ceiling surface. A suction panel 12 is releasably attached to the opening 2, which faces the ceiling surface, by a fastening means (not shown) such as a spring so as to close the opening 2. A suction chamber 4 inside the main body frame 1 is formed into a space enclosed by rigid body surfaces including the inner peripheral surface of the main body frame 1, a suction partition 3, and the suction panel 12. A suction passage 15 extending from suction ports 13 to a fan suction port 8 via the suction chamber 4 is nonlinear.

The fan suction port 8 is open downward and is substantially in the middle of the suction partition 3 that halves the main body frame 1 into the opening side 2 and the blower chamber side 5. At the edge on the suction chamber 4 side of the fan suction port 8 is a hollow and doughnut-like straightening guide 18. The straightening guide 18 has a projection toward the suction chamber 4 (H-h as viewed in FIG. 1) and an appropriate thickness in the radial direction (1 as viewed in FIG. 1), and has at the center thereof a guide passage 17 whose diameter (d as viewed in FIG. 1) matches the fan suction port 8.

This straightening guide 18 is a rigid monolithic molding made of plastic in circular jacket tube form whose wall thickness is uniform. As shown in FIG. 2, the straightening guide 18 is firmly screwed to the suction partition 3 through a plurality of mounting flanges 20 formed along an outer circumferential section 19 on the back thereof. The hollow portion of the straightening guide 18 is closed on the back by the suction partition 3 while fixed on the suction partition 3. A free end of the inner wall forming the guide passage 17 of the straightening guide 18 is bent so as to match the bell-mouthed bent surface of the fan suction port 8. Further, a portion contiguous from the inner wall to a flat section 21 in the thickness 1 direction is curved and is molded in R form, so that the entrance of the guide passage 17 is bell-mouthed.

With the straightening guide 18, the suction chamber 4 enclosed by the rigid body surfaces is formed into a space having a recess in the middle in terms of a section, and a wide outer side section and provided with the guide passage 17 that is open in the middle. The section narrowed by the projection (H-h) of the straightening guide 18 constitutes a constructed section 22 that is within a flat plate area of the front panel portion 14 on the front of the suction panel 12. Each suction port 13 of the suction panel 12 opens toward the suction partition 3 while facing the outer side section of the suction chamber 4, and communicates with a wide portion 23 in the outer side section of the suction chamber 4. That is, the suction passage 15 of the blowing apparatus extends from the suction ports 13 of the suction panel 12 to the fan suction port 8 via the wide portion 23 of the suction chamber 4, the contracted section 22, and the guide passage 17.

Figure 4:
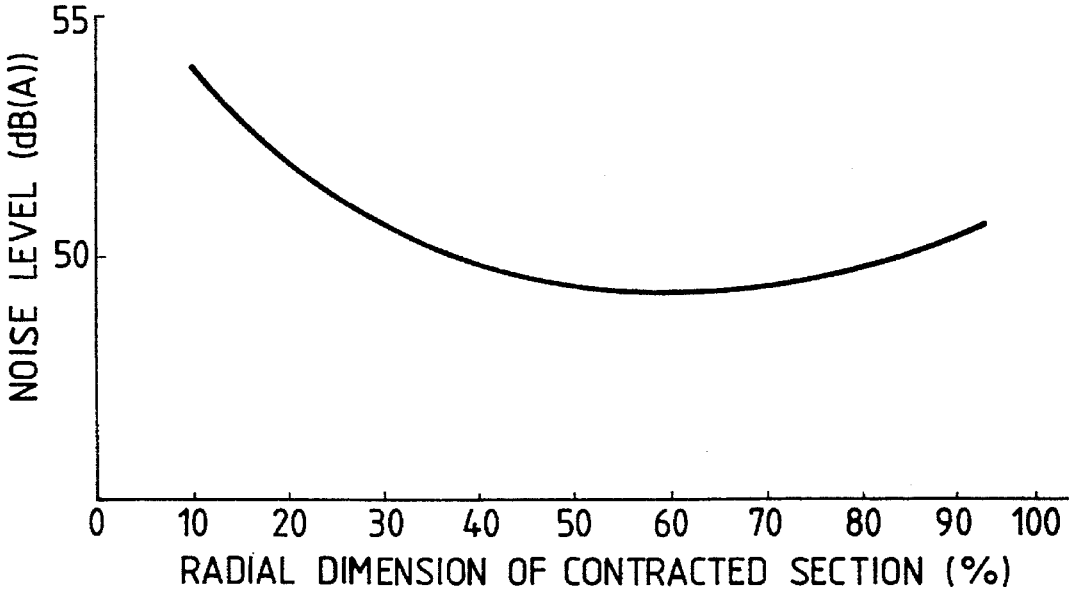
FIG. 4 is a diagram illustrative of a relationship between the radial dimension of the contracted section of FIG. 1 and the noise level.

The height h of the contracted section 22 (the distance between the flat section 21 of the straightening guide 18 and the back of the suction panel 12) is set to a value approximately 30 to 70% the height H of the suction chamber 4 (the distance between the suction partition 3 and the back of the suction panel 12). Satisfactory results have been obtained when h is set to a value 55 to 65% the height H. The thickness 1 in the radial direction of the straightening guide 18 which defines the size of the contracted section 22 is set to at least 10% or more the diameter of the fan suction port 8, extending substantially from the outer circumferential end position of the fan suction port 8, but not exceeding the front panel portion 14 of the suction panel 12 at the maximum. Satisfactory results have been obtained when 1 is set to a value 30 to 90% the diameter of the fan suction port 8 as shown in FIG. 4. That is, the contracted section 22 is formed between each suction port 13 and the fan suction port 8 (with an appropriate thickness).

Even in the thus constructed blowing apparatus, air is sucked from the suction ports 13 to the fan suction port 8 via the suction chamber 4 by the rotation of a motor 6. At this time, as shown by the arrows in FIG. 3, a rapid stream entering from the relatively narrow suction ports 13 is introduced into the wide portion 23 of the suction chamber 4 which is on the outer circumferential section 19 side of the straightening guide 18, and is therein decelerated by sudden expansion of the suction passage 15. While the deceleration slightly aggravates the turbulence of the stream in the suction passage 15, the inertia with which the rapid stream flowed at the outset is mitigated, so that the flow of the stream becomes dependent on the sucking force produced at the fan suction port 8 by a multiblade fan 7.

The stream leaving the wide portion 23 of the suction chamber 4 continuously flows into the contracted section 22. Upon entrance into the contracted section 22, the level of the turbulence caused previously, i.e., the magnitude of the vortex causing the turbulence, is scaled down as the stream passes through the narrow contracted section 22, so that the stream becomes less turbulent. Such less turbulent stream is then sucked into the guide passage 17 of the straightening guide 18 after leaving the contracted section 22 while whirling in the direction substantially at right angles to the exit of the contracted section 22.

The stream sucked into the guide passage 17 is further sucked into the fan suction port 8. Since an approach to the fan suction port 8 is provided by the guide passage 17, the stream is straightened to become uniform along such approach. Therefore, the stream sucked from the fan suction port 8 to the multiblade fan 7 is substantially uniform and less turbulent. As a result, the fan noise can be reduced remarkably, compared with the conventional examples in which the multiblade fan 7 sucks a turbulent stream.

Further, the fan noise is a source which causes acoustic resonance (a standing wave of noise produced within the suction chamber 4) in the fan noise propagation process if there is no obstacle within the suction chamber 4 enclosed by the rigid body surfaces. Thus, resonance is easily generated. The blowing apparatus of this embodiment, however, has the straightening guide 18 in jacket tube form projecting toward the suction chamber 4, and such projection allows no confronting surfaces parallel with the rigid body surfaces of the main body frame 1 and the outer circumferential surface of the straightening guide 18 to be formed. Therefore, acoustic resonance is prevented. In addition, the fan noise itself, which is the resonance causing source, is reduced as described above, so that the occurrence of resonance can be further controlled.

(Embodiment 2)

Figure 5:
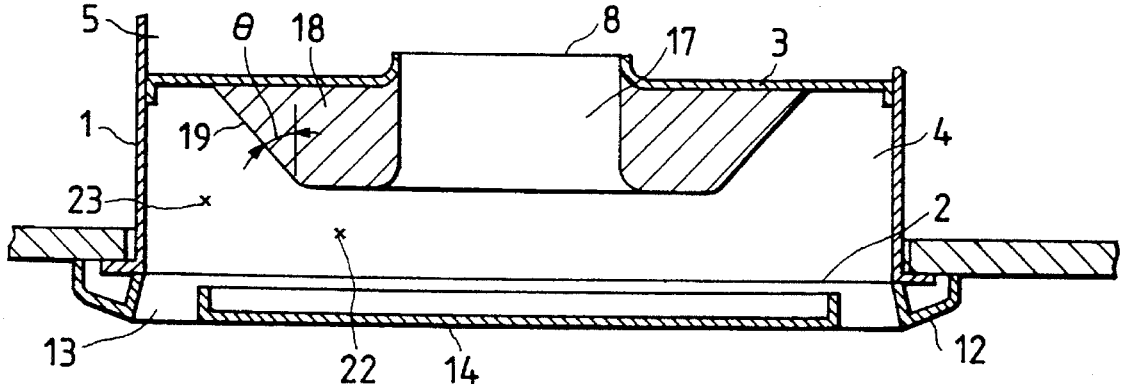
FIG. 5 is a sectional view of the main portion of a blowing apparatus according to Embodiment 2 of the invention.

While the straightening guide 18 of Embodiment 1 is such a hollow body as to form a closed space therein while fixed to the suction partition 3, a similar effect can be obtained by forming the straightening guide 18 of a solid body. Further, as shown in FIG. 5, the straightening guide 18 may be a truncated cone whose outer diameter is gradually increased toward the suction partition 3. In this case, while the outer circumferential section 19 of the straightening guide 18 is tapered, the opening angle θ is not set to too large a value, preferably 45° or less so as to obtain satisfactory results. That is, the height and width of the constructed section may not necessarily be uniform in the radial and circumferential directions.

(Embodiment 3)

Figure 6:
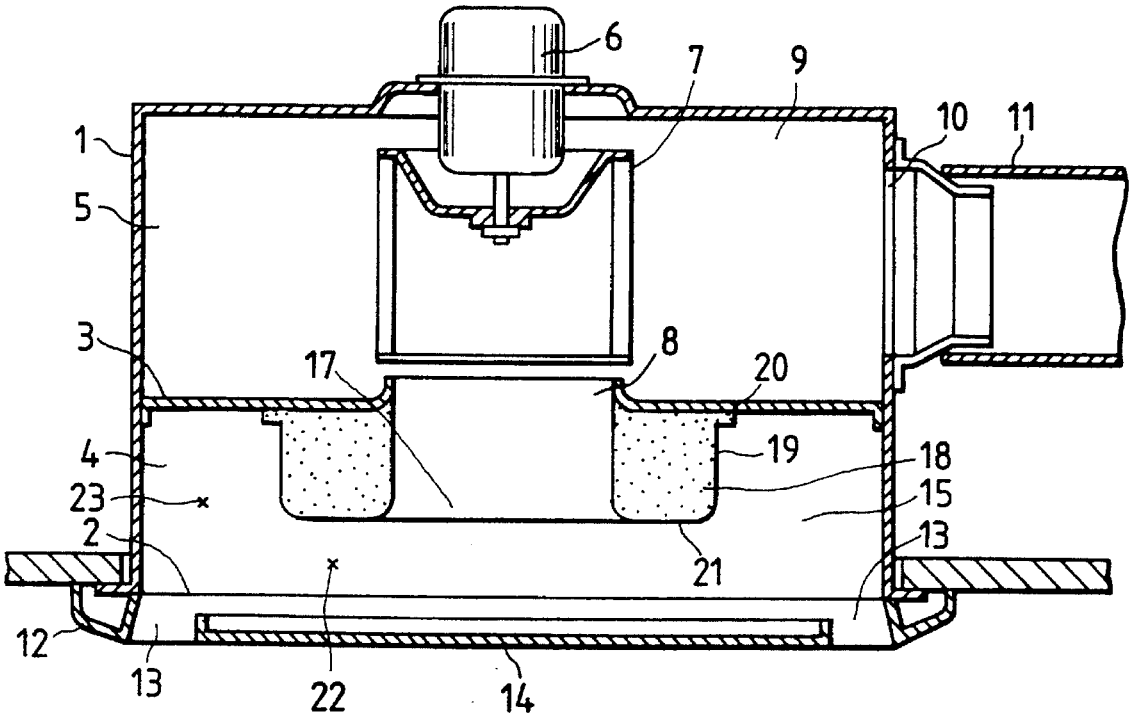
FIG. 6 is a longitudinal sectional view of a blowing apparatus according to Embodiment 3 of the invention.
Figure 7:
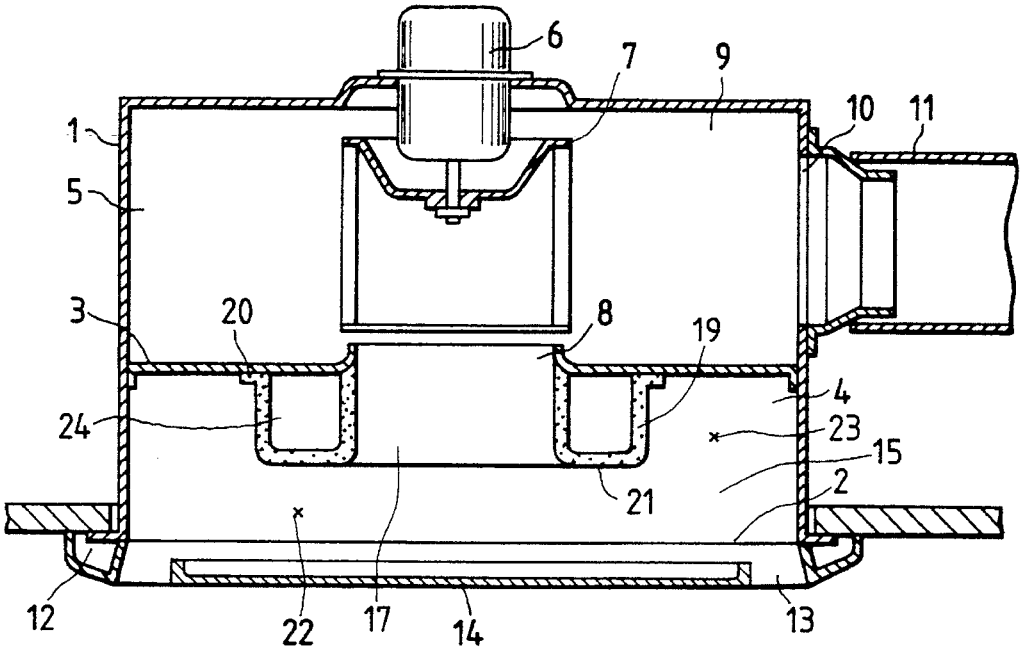
FIG. 7 is a longitudinal sectional view of the blowing apparatus according to Embodiment 3 of the invention.

This embodiment is characterized in that the straightening guide 18 in Embodiment 1 or 2 is formed of a noise absorbing member such as noise absorbing plastic, which is a porous material. FIG. 6 shows the straightening guide 18 formed of a noise absorbing member into a solid body. FIG. 7 shows the straightening guide 18 formed of a noise absorbing member into a hollow body, with the hollow portion constituting a back air layer 24. Other structural aspects are the same as those of Embodiment 1. Therefore, those parts and components are designated by the same reference materials, and the description thereof will be omitted.

The flow process of the blowing apparatus of Embodiment 3 is similar to Embodiment 1; that is, the stream is introduced from the suction ports 13 to the wide portion 23 of the suction chamber 4, passes through the contracted section 22 to the guide passage 17 of the straightening guide 18, and finally reaches the fan suction port 8. Therefore, this embodiment provides the same effect as Embodiment 1. This embodiment is characterized as forming the straightening guide 18 of a porous noise absorbing member to give the straightening guide 18 a noise damping function. Therefore, fan noise to be propagated from the fan suction port 8 to the suction ports 13 can be absorbed in the propagation process, thus allowing noise to be further reduced. While the blowing apparatus having the back air layer 24 shown in FIG. 7 performs the above-mentioned noise absorbing function, this type is distinguished from the others in that not only the depth of the back air layer can be adjusted in accordance with the fan noise frequencies to be reduced, but also whether or not the back air layer is provided can be selected.

(Embodiment 4)

Figure 8:
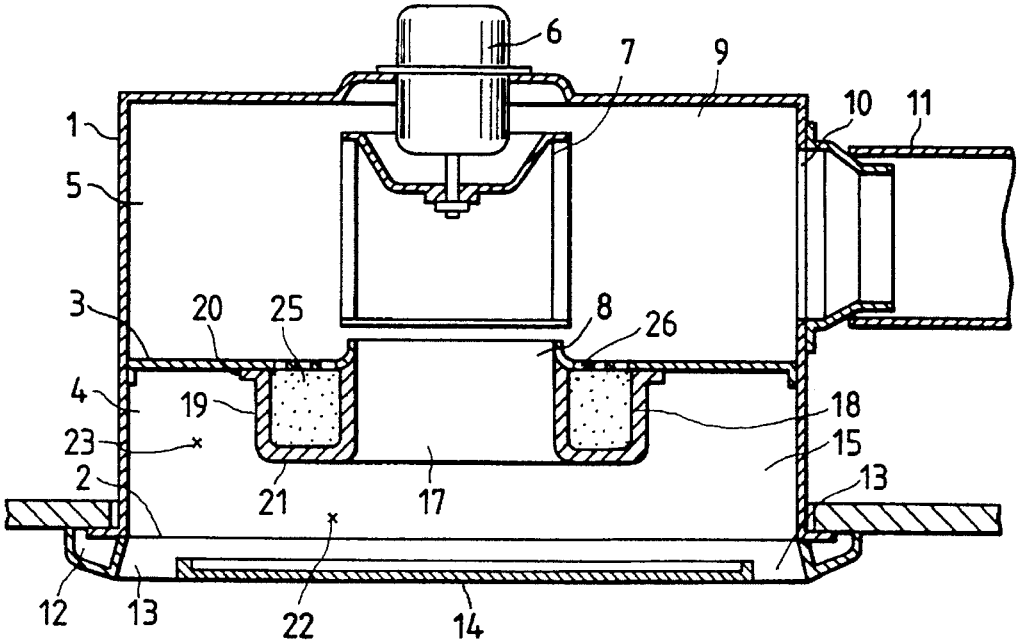
FIG. 8 is a longitudinal sectional view of a blowing apparatus according to Embodiment 4 of the invention.
Figure 9:
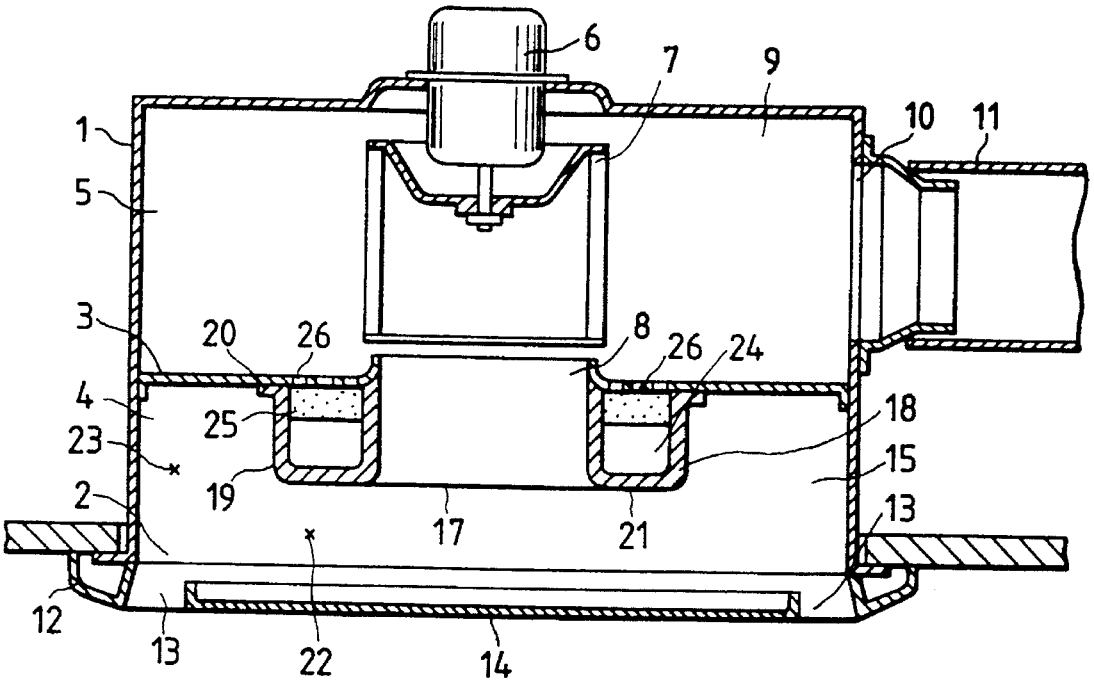
FIG. 9 is a longitudinal sectional view of the the blowing apparatus according to Embodiment 4 of the invention.

This embodiment is characterized as filling a noise absorbing member 25 such as porous noise absorbing plastic in all or a suction partition 3 side part of the closed space of the straightening guide 18 of Embodiment 1 as shown in FIGS. 8 and 9. The suction partition 3 that closes the hollow portion of the straightening guide 18 has, in that particular portion, an air introducing section 26 formed of tiny holes or slits so that the opening rate of the air introducing section 26 is 30% or more. The air introducing section 26 opens toward the blowout side of the multiblade fan 7 that is on the blower chamber 5 side. Other structural aspects are the same as those of Embodiment 1. Therefore, the same parts and components as those of Embodiment 1 are designated by the same reference numerals, and the description thereof will be omitted.

The flow process of the blowing apparatus of Embodiment 4 is also similar to Embodiment 1; that is, the stream is introduced from the suction ports 13 to the wide portion 23 of the suction chamber 4, passes through the contracted section 22 to the guide passage 17 of the straightening guide 18, and finally reaches the fan suction port 8. Therefore, this embodiment provides the same effect as Embodiment 1. This embodiment is particularly effective in reducing fan blowout noise produced at the multiblade fan 7. This is, the fan blowout noise produced on the blowout side of the multiblade fan 7 is damped and reduced by the noise absorbing member 25 filled in the straightening guide 18 from the air introducing section 26. Since the fan blowout noise is propagated also to the fan suction port 8, the reduction of the fan blowout noise brings about a reduction of noise at the suction ports 13 which reflects the fan blowout noise reduction. The blowing apparatus in which the noise absorbing member 25 is filled in a part of the suction partition 3 side of the straightening guide 18 can adjust the distribution of space between the noise absorbing member 25 and the back air layer 24 in accordance with the specific noise frequencies to be reduced.

(Embodiment 5)

Figure 10:
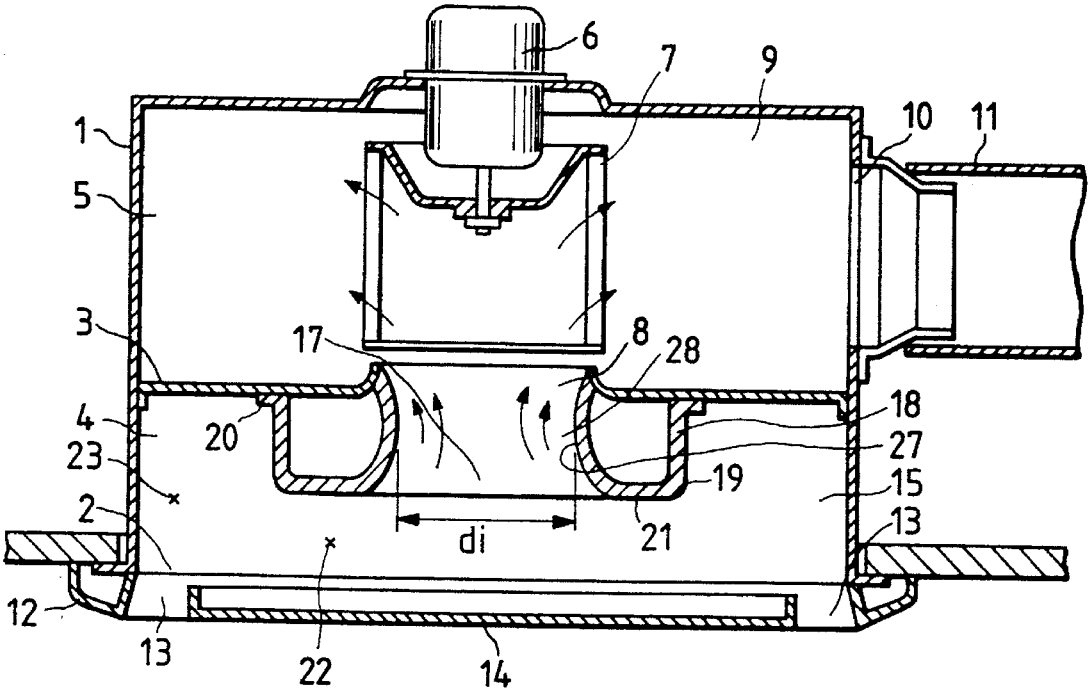
FIG. 10 is a longitudinal sectional view of a blowing apparatus according to Embodiment 5 of the invention.

As shown in FIG. 10, this embodiment is characterized by the guide passage 17 of the straightening guide 18. Other structural aspects are the same as those of Embodiment 1. Therefore, the same parts and components as those of Embodiment 1 are designated by the same reference numerals, and the description thereof will be omitted.

While the straightening guide 18 of this blowing apparatus may be hollow or solid, the guide passage 17 has a constricting section 28 formed of a bent inner surface 27 in the middle of the guide passage 17. As a result of the above construction, the inner diameter of the guide passage 17 is gradually decreased from the entrance to the middle and gradually increased from the middle to the fan suction port 8 so as to form a concave inner surface. The entire part of the inner circumferential surface of the guide passage 17 is smoothly curved. The inner diameter di of the constricting section 28 is set to a value approximately 80 to 90% the diameter of the fan suction port 8.

The flow process of the blowing apparatus of Embodiment 5 is also similar to Embodiment 1; that is, the stream is introduced from the suction ports 13 to the wide portion 23 of the suction chamber 4, and passes through the contracted section 22 to the guide passage 17 of the straightening guide 18. This embodiment is characterized as moderately constricting the stream introduced into the guide passage 17 toward the constricting section 28 in the middle as shown by the arrows in FIG. 10 and then slightly expanding the stream in the radial direction to the fan suction port 8 so that the stream can be ushered into a wide range of blades of the multiblade fan 7. Therefore, the steam sucked into the multiblade fan 7 can be distributed more evenly in the width direction of the multiblade fan 7, thereby improving fan efficiency and fan noise reduction. Other functions and effect are the same as those of Embodiment 1, and the description thereof will be omitted.

(Embodiment 6)

Figure 11:
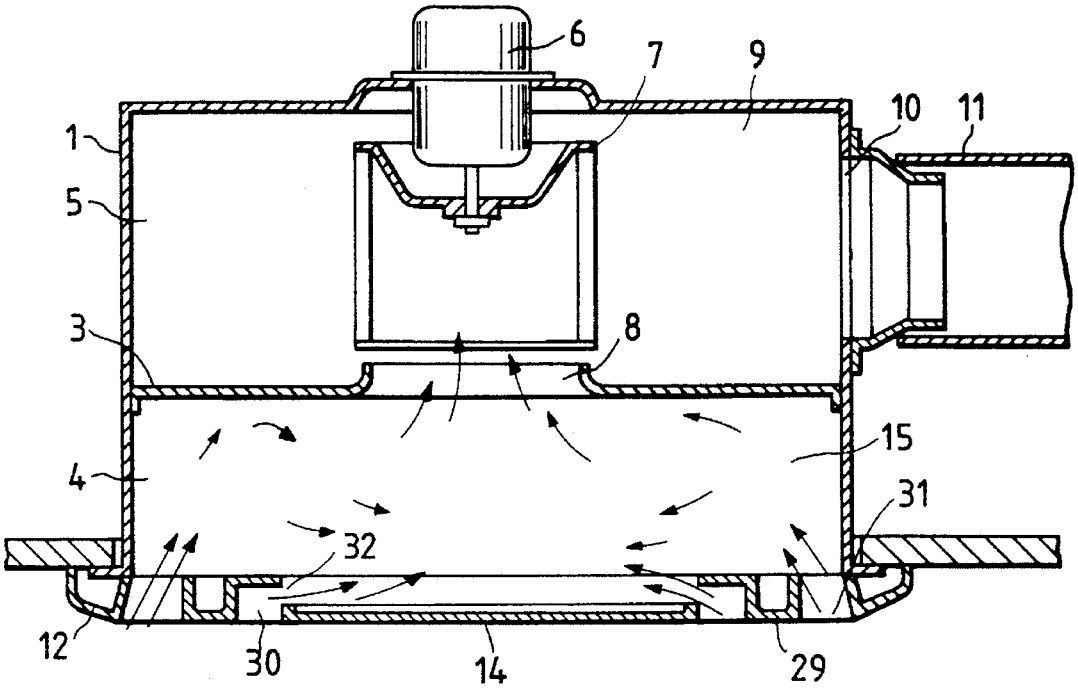
FIG. 11 is a longitudinal sectional view of a blowing apparatus according to Embodiment 6 of the invention.
Figure 12:
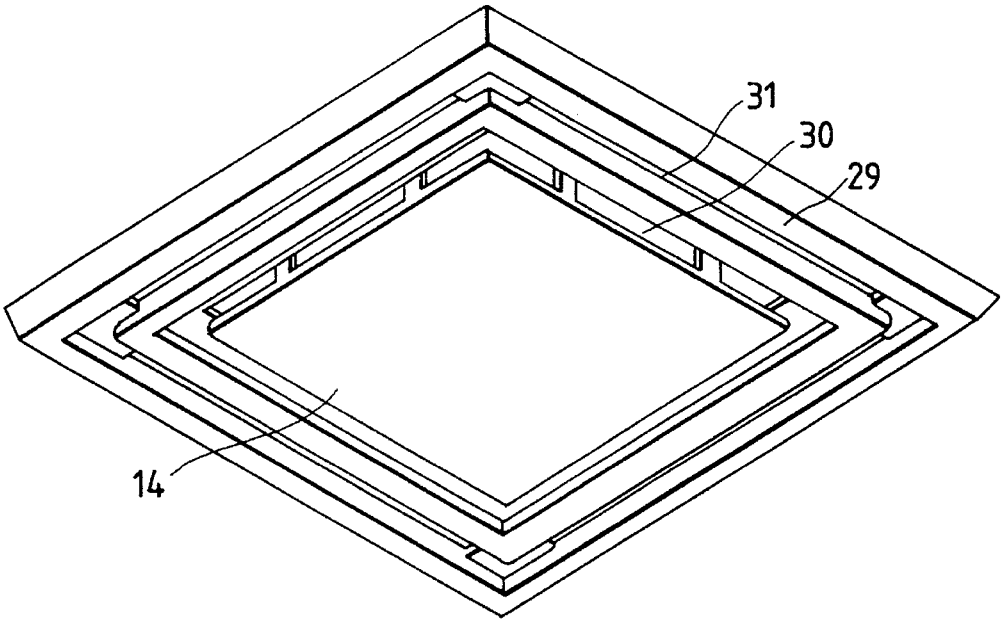
FIG. 12 is a perspective view of the suction panel according to Embodiment 6 of the invention.

This embodiment is characterized by the suction panel 12 as shown in FIGS. 11 and 12. Other basic structure of the blowing apparatus is the same as that of Embodiment 1. Therefore, the same parts and Components as those of Embodiment 1 are designated by the same reference numerals, and the description thereof will be omitted.

The suction panel 12 has first and second suction ports 30 and 31. The first suction ports 30 that are slit-like and communicate with the suction chamber 4 are provided in a panel base body 29 that can close the opening 2 of the main body frame 1 so as to enclose the fan suction port 8. The second suction ports 31 that are slit-like and communicate with the suction chamber 4 are provided outside the first suction ports 30 so as to be distanced from the first suction ports 30 by the opening width of the first suction port 30. The suction panel 12 itself is releasably attached to the opening 2 of the main body frame 1 like a cover by a fastening means (not shown) such as a spring.

The first suction ports 30 are formed on the four sides or on two opposing sides of the panel base body 29 in parallel with each other so as to enclose the outer side of the fan suction port 8 within almost all the range of projection of the fan suction port 12 onto the panel base body 29. Opening ends 32 on the suction chamber 4 side of the first suction ports 30 open toward the center of the fan suction port 8. The second suction ports 31 are formed on the four sides or on two opposing sides of the panel base body 29 in parallel with each other outside the first suction ports 30 so as to enclose the first suction ports 30. The opening ends on the suction chamber 4 side of the second suction ports 31 open toward the suction partition 3. The second suction ports 31 are often disposed at a position corresponding to the outer peripheral surfaces of the main body frame 1 as shown in FIGS. 11 and 12 for design considerations. A portion enclosed by the first suction ports 30 constitutes the front panel portion 14 that conceals the front of the fan suction port 8. In this embodiment, the straightening guide 18 on the main body frame 1 side may be eliminated. If the straightening guide 18 such as shown in Embodiment 1 is provided, the opening ends 32 on the suction chamber 4 side of the first suction ports 30 are disposed at a position that is within the thickness 1 in the radial direction of the straightening guide 18 as shown in FIG. 13.

In this embodiment, if no straightening guide 18 is provided, the sucked air flows as shown by the arrows in FIG. 11. That is, the rapid stream introduced from the second suction ports 31 is drastically decelerated by the sudden expansion thereof upon entrance into the suction chamber 4 with the inertia thereof being lessened, thereby making itself dependent on the sucking force produced at the fan suction port 8 by the multiblade fan 7. The stream introduced into the suction chamber 4 is not decelerated uniformly, and flows therethrough while picking up air within the suction chamber 4. As a result, the direction of the stream is not fixed, eventually making the stream unstable. In the meantime, the stream from the first suction ports 30 is introduced toward the center of the fan suction port 8, and this stream from the first suction ports 30 ushers and whirls the stream from the second suction ports 31, which tends to become unstable, into the fan suction port 8. As a result, the direction of the stream in the entire part of the suction chamber 4 becomes stable, so that the stream can enter into the fan suction port 8 in the fixed direction. Hence, the blowing apparatus of this embodiment can reduce fan noise further than the conventional apparatuses in which the multiblade fan 7 sucks a very turbulent stream.

Figure 13:
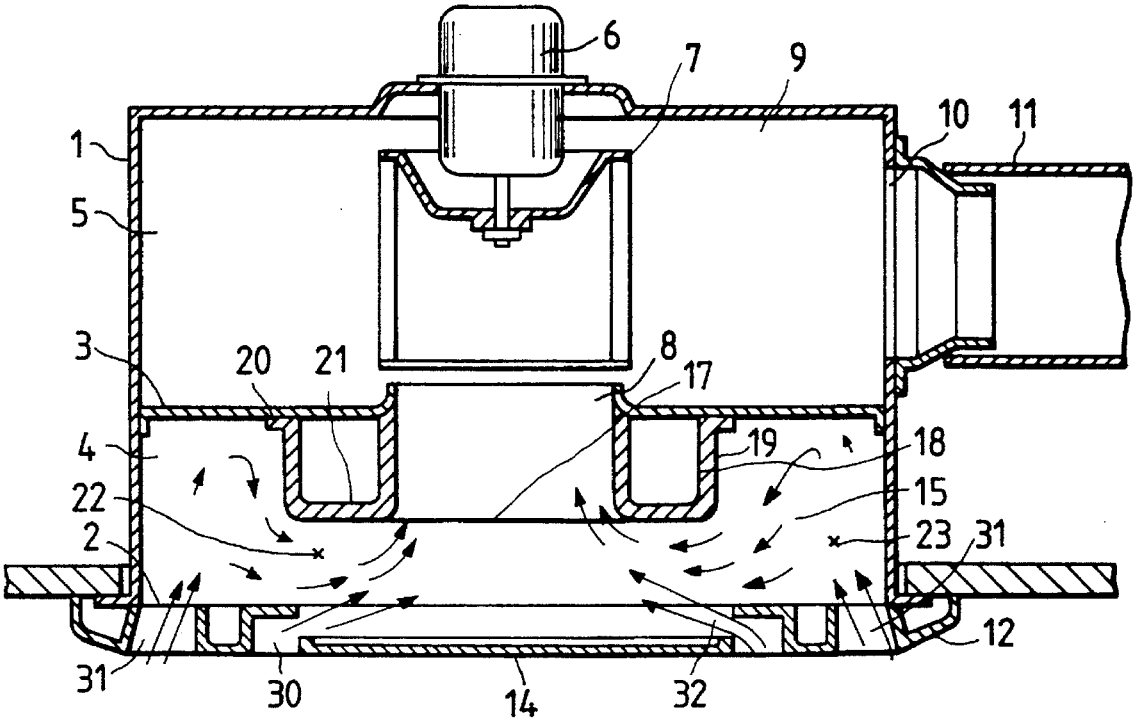
FIG. 13 is a longitudinal sectional view of a blowing apparatus according to Embodiment 7 of the invention.

Further, if the straightening guide 18 such as shown in Embodiment 1 is provided, the sucked stream becomes as shown by the arrows in FIG. 13; that is, the stream in Embodiment 1 is superposed upon the stream in FIG. 11. More specifically, the rapid stream entering from the second suction ports 31 flows into the wide suction chamber 4 outside the straightening guide 18 and is decelerated therein by the sudden expansion of the suction passage 15. The deceleration slightly increases the turbulence of the stream, but the inertia with which the rapid stream flowed at the outset is mitigated, which makes the stream dependent on the sucking force produced at the fan suction port 8 by the multiblade fan 7.

The stream that has been through with the wide potion 23 of the suction chamber 4 continues to flow into the contracted section 22. Upon entrance into the contracted section 22, the level of the turbulence caused previously, i.e., the magnitude of the vortex that causes the turbulence is scaled down to make the stream less turbulent as the stream passes through the contracted section 22. In the meantime, the stream from the first suction ports 30 enters toward the center of the guide passage 17 of the straightening guide 18, ushering and whirling the stream passing through the contracted section 22 into the guide passage 17. Therefore, the stream flowing into the guide passage 17 becomes stable.

Figure 14:
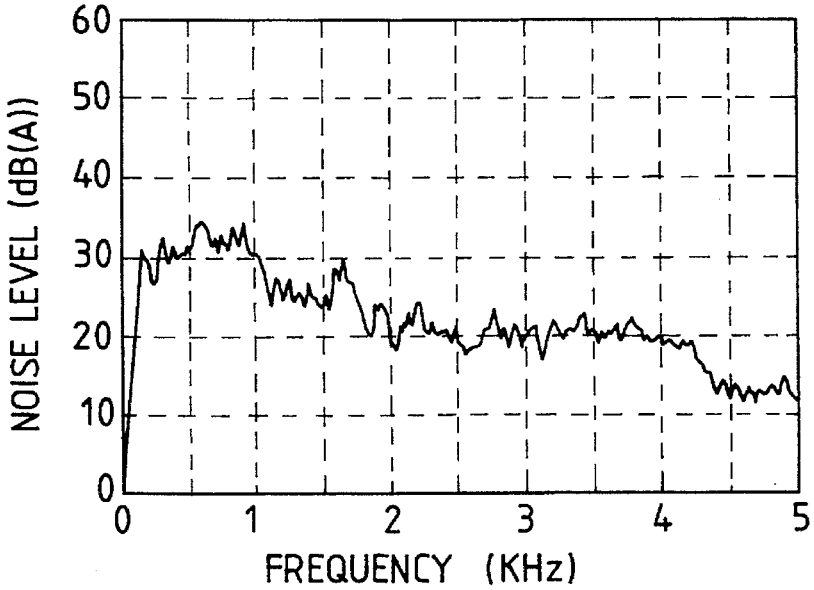
FIG. 14 is a frequency spectra graph illustrative of the noise produced by the blowing apparatus according to Embodiment 7 of the invention.

The stream sucked into the guide passage 17 is further sucked into the fan suction port 8. Since an approach to the fan suction port 8 is provided by the guide passage 17, the stream is straightened to become uniform along such approach. Therefore, the stream sucked from the fan suction port 8 to the multiblade fan 7 becomes substantially uniform and less turbulent. As a result, the fan noise can be reduced remarkably, compared with the conventional examples in which the multiblade fan 7 sucks a turbulent stream. Other functions performed by the straightening guide 18 are the same as those of Embodiment 1, and the description thereof will be omitted. FIG. 14 is a frequency characteristic graph with respect to the noise produced by the blowing apparatus of this embodiment. Not only the resonance heretofore generated at 500 Hz and 1 kHz is eliminated, but also there is no peak in frequencies over 2 kHz. The noise level dropped by about 5 to 10 dB (A). The graph in FIG. 14 is based on front noise data measured 1 m below the suction panel 12 in front of the suction panel 12 according to the standards stipulated by the Japanese Electric Industry Association.

While the opening ends 32 on the suction port 4 side of the first suction ports 30 open toward the center of the fan suction port 8 in Embodiment 6, the first suction ports 30 may open toward the fan suction port 8 or the guide passage 17 of the straightening guide 18 by setting the distance between the first suction ports 30 and the second suction ports 31 as described above, whereby substantially the same effect as in Embodiment 6 can be obtained.

(Embodiment 7)

By replacing the suction panel 12 of Embodiment 6 with the suction panel 12 of Embodiment 1, 2, 3, 4, or 5, the function of each embodiment can be superposed upon the function of this suction panel 12. Therefore, a more effective noise reduction can be achieved.

(Embodiment 8)

Figure 15:
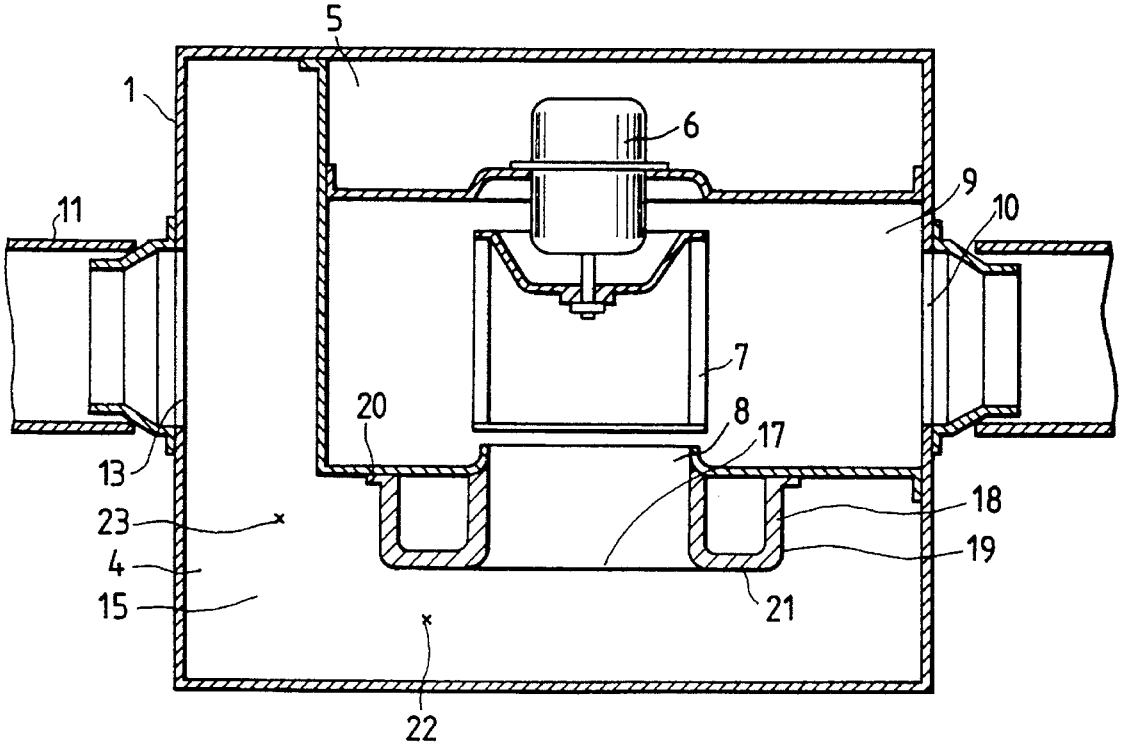
FIG. 15 is a longitudinal sectional view of a blowing apparatus according to Embodiment 8 of the invention.

As shown in FIG. 15, this embodiment is characterized as forming the main body frame 1 as a box with no opening and opening the suction port 13 to be connected to the piping member 11 toward a side opposite to the blowout port 10. Therefore, this blowing apparatus has no suction panel. The suction chamber 4 is formed into an L-shaped space enclosed by the inner peripheral and bottom surfaces of the main body frame 1 and the outer surface of the blower chamber 5. By arranging such a straightening guide 18 as shown in each embodiment at the fan suction port 8 as shown in FIG. 15, the straightening guide 18 can perform the functions described with reference to the straightening guide 18 of each embodiment to reduce noise also in this blowing apparatus.

(Embodiment 9)

Figure 16:
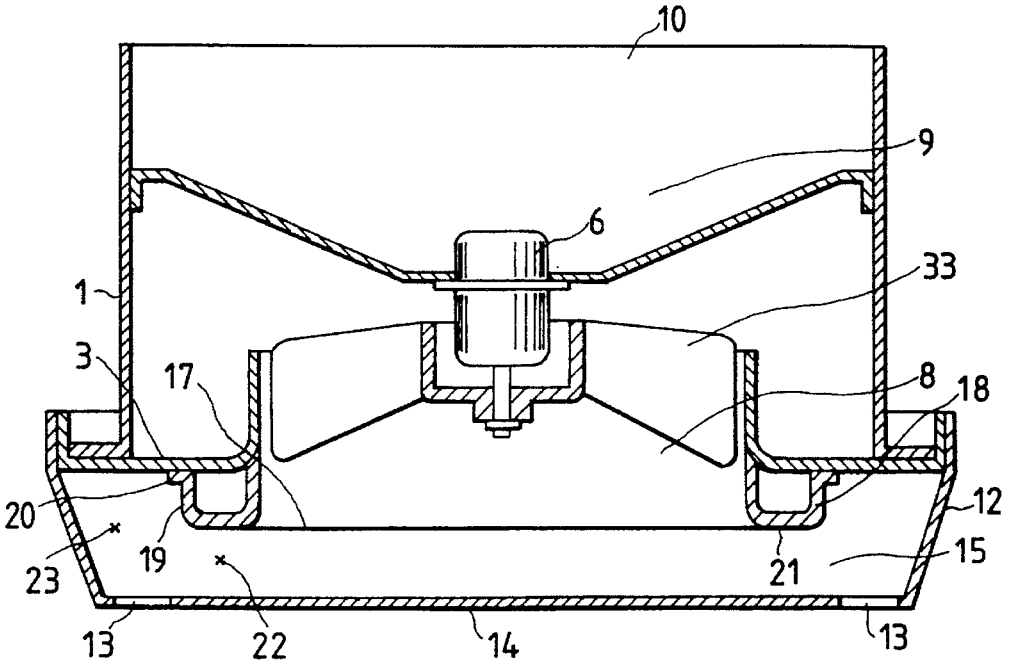
FIG. 16 is a longitudinal sectional view of a blowing apparatus according to Embodiment 9 of the invention.

As shown in FIG. 16, this embodiment is characterized as implementing the blower by a propeller fan 33 so as to be applied to a blowing apparatus such as a ventilating fan. By arranging such a straightening guide 18 as shown in each embodiment at the opening edge of the fan suction port 8 as shown in FIG. 16, the straightening guide 18 can perform the functions described with reference to the straightening guide 18 of each embodiment to reduce noise also in this blowing apparatus.

As is apparent from the foregoing description of the embodiments, according to the first aspect of the invention, the stream sucked from the suction port while passing through the contracted section and the guide passage is straightened into a uniform one, and further sucked into the blower in less turbulent conditions. Therefore, not only fan noise can be reduced, but also resonance is hard to occur acoustically due to the projection of the outer circumferential surface of the straightening guide allowing no opposed rigid body surfaces of the main body frame to be formed in the suction chamber. Moreover, since the fan noise itself, which becomes the source for causing resonance, is reduced, occurrence of the resonance can be further controlled.

In addition to the effect provided by the first aspect of the invention, according to the second aspect of the invention, the stream introduced into the guide passage is moderately constricted toward the constricting section in the middle, and then expanded in the radial direction toward the fan suction port. Therefore, the stream can be ushered into a wide range of blades of the blower of the multiblade fan, thus contributing to the improvement of fan efficiency and the reduction of fan noise.

In addition to the effects provided by the first and second aspects of the invention, according to the third aspect of the invention, the blowout noise of the blower can be reduced by the noise absorbing member filled in the straightening guide through the air introducing section, which contributes to total noise reduction.

In addition to the effects obtained by the first and second aspects of the invention, according to the fourth aspect of the invention, adjustment of noise reduction in specific frequencies can be made by changing the distribution of space between the noise absorbing member filled in the straightening guide through the air introducing section and the back air layer. Therefore, a more effective noise reduction can be achieved.

According to the fifth aspect of the invention, the turbulence within the suction chamber of the stream from the second suction ports can be induced to the fan suction port by the stream from the first suction ports. Therefore, the stream in the entire part of the suction chamber becomes stable, so that fan noise of the blowing apparatus can be reduced.

According to the sixth aspect of the invention, the turbulence within the suction chamber of the stream from the second suction ports can be induced toward the center of the fan suction port by the stream from the first suction ports. Therefore, the direction of the stream within the entire part of the suction chamber becomes stable, so that the fan noise of the blowing apparatus can be further reduced.

According to the seventh aspect of the invention, the effect obtained by the first aspect of the invention is superposed upon the effect obtained by the fifth aspect of the invention. Therefore, a better noise reduction can be achieved.

According to the eighth aspect of the invention, the stream from the suction ports to the fan suction port can be straightened into a uniform one by only applying the straightening guide to the blowing apparatus in which the suction ports and the fan suction port open toward the suction chamber enclosed by the rigid body surfaces and the suction passage is formed of these three parts nonlinearly. Therefore, the noise produced by the blowing apparatus can be reduced easily with a simple design.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A blowing apparatus, comprising:

a blower;

a suction chamber enclosed by rigid body surfaces;

a first suction port opening toward said suction chamber for sucking air from outside said suction chamber;

a second suction port serving as a port for said blower, said first suction port, said suction chamber and said second suction port constituting a suction passage; and a straightening guide provided at an opening of said second suction port on a suction chamber side, said straightening guide having a toroidal shape which projects into said suction chamber, a thickness in a radial direction and a bell-mouthed shaped opening facing the suction chamber.

2. The apparatus according to claim 1, wherein said straightening guide has a constricting section formed on the inner diameter of said straightening guide and having a curved inner surface wherein the inner diameter of said straightening guide is gradually increased from said constricting section toward said second suction port.

3. A blowing apparatus according to claim 1 or 2, wherein said straightening guide is hollow and is partially filled with a noise absorbing material.

4. The apparatus according to claim 1 or 2, wherein said straightening guide is a hollow straightening guide; a noise absorbing member partially fills said hollow straightening guide with the remainder of said hollow straightening guide comprising a back air space situated on said suction chamber side of said hollow straightening guide; and wherein said hollow straightening guide communicates with a blowout side of said blower through an air introducing section.

5. A blowing apparatus according to claim 1, wherein one surface of said suction chamber is formed of a suction panel having a first and a second suction port communicating with said suction chamber, said first suction port opening toward a surface of said suction chamber opposite to the one surface, said second suction port distant from said first suction port by at least an opening width of said first suction port.

6. A suction panel for stabilizing an air stream and concealing a blower in a blowing apparatus in which the blowing apparatus includes a suction chamber enclosed by rigid body surfaces with one open surface; and a fan suction port serving as a suction port for the blower, said suction panel being attached to said blowing apparatus so as to close the open surface, said suction panel comprising:

a front panel portion for allowing the open surface to be closed so as to conceal the blower, a first and a second suction port communicating with said suction chamber wherein said second suction port is spaced apart from said first suction port by at least one opening width of said first suction port, said first suction port having a protecting portion projecting toward a center of the suction chamber and parallel to said front panel portion, wherein an air stream from said first suction port is directed by said projecting portion toward the center of the suction chamber so as to usher an air stream from said first and second suction ports into the fan suction port and thereby stabilize and guide the air stream into the fan suction port.

7. A suction panel for stabilizing an air stream and concealing a blower in a blowing apparatus in which the blowing apparatus includes a suction chamber enclosed by rigid body surfaces with one open surface and a fan suction port serving as a suction port for the blower, said suction panel being attached to the blowing apparatus so as to cover the open surface, said suction panel comprising:

a front panel portion for allowing the open surface to be covered so as to conceal the blower, a first suction port communicating with the suction chamber, and a second suction port communicating with the suction chamber and positioned outside said first suction port distant from said first suction port by at least an opening width of said first suction port, said first suction port including a projecting portion projecting toward a center of the suction chamber and substantially parallel to said front panel portion, wherein an air stream from said first suction port is directed by said projecting portion toward the center of the suction chamber so as to usher an air stream from said first and second suction ports into the fan suction port and thereby stabilize and guide the air stream into the fan suction port.

8. A straightening guide for a blowing apparatus, in which said blowing apparatus comprises a suction passage including: a suction chamber enclosed by rigid body surfaces; suction ports respectively opening toward said suction chamber for sucking air from outside said suction passage; and a fan suction port serving as a suction port for a blower, said suction ports, said suction chamber, and said fan suction port being arranged in nonlinear form, said straightening guide being attached to an opening of said fan suction port on said suction chamber side of said blowing apparatus, said straightening guide having a toroidal shape with a center guide passage and a projection which projects into said suction chamber, said center guide passage matching said fan suction port.

9. An apparatus comprising:

a suction chamber, a blower chamber, a partition separating said suction chamber from said blower chamber, a first port disposed on a wall of said suction chamber, a second port disposed on said partition permitting flow communication between said suction chamber and said blower chamber, an annular guide provided at the mouth of said second port said annular guide projecting into said suction chamber and having a portion of said annular guide which faces said suction chamber tapered to form a bell-mouth shape.

10. The apparatus of claim 9, wherein said annular guide is hollow.

11. The apparatus of claim 9, wherein said annular guide is comprised of a noise reducing material.

12. The apparatus of claim 11, wherein said noise reducing material is plastic.

13. The apparatus of claim 9, wherein an outer surface of said annular guide has a truncated cone shape.

14. The apparatus of claim 13, wherein said annular guide is comprised of a noise reducing material.

15. The apparatus of claim 14, wherein said noise reducing material is plastic.

16. The apparatus of claim 9, wherein an inner diameter of said annular guide gradually decreases and then gradually increases from a suction chamber side to a blower chamber side of said annular guide.

17. The apparatus of claim 15, wherein an inner surface of said annular guide has a concave shape.

18. The apparatus of claim 16, wherein said annular guide is comprised of a noise reducing material.

19. The apparatus of claim 18, wherein said noise reducing material is plastic.

20. The apparatus of claim 10, wherein a portion of said hollow annular guide which is closest to the partition is partially filled with noise reducing material.

21. The apparatus of claim 20, wherein a portion of said hollow annular guide not filled with noise reducing material forms a back air space within said hollow annular guide.

22. The apparatus of claim 20, wherein said partition extends to an outer wall of said hollow guide and wherein a portion of said partition includes an air introducing section having holes separates said hollow annular guide from said blower chamber and permits air to flow between the interior of said hollow annular guide and said blower chamber.

23. The apparatus of claim 20, wherein said noise reducing material is plastic.

24. The apparatus of claim 9, wherein an opening of the second port facing said suction chamber has a bell-mouth shape.

25. The apparatus of claim 9, wherein the projection of said annular guide into said suction chamber constricts a center portion of said suction chamber to form a constricted section and wherein the height of the constricted section is from 30% to 70% of the height of said suction chamber.

26. The apparatus of claim 9, wherein said annular guide has an annular thickness which is greater than 10% of the diameter of said second port.

27. The apparatus of claim 26, wherein the annular thickness of said annular guide is from 30% to 90% of the diameter of said second port.

28. The apparatus of claim 9, wherein said annular guide is mounted to said partition with a flange.

29. The apparatus of claim 9, wherein said suction chamber includes a panel disposed opposite to said second port and said first port further includes an outer port and an inner port wherein said outer port is disposed closer to an outer edge of said panel than said inner port and wherein said inner port has an opening on a suction side which is directed towards said second port.

30. The apparatus of claim 29, wherein said panel is releasably attached to said suction chamber.

31. The apparatus of claim 29, wherein said inner port is spaced apart from the outer port by at least the distance of the opening width of said inner port.

32. The apparatus of claim 13, wherein said suction chamber includes a panel disposed opposite to said second port and said first port is further comprised of an outer port and an inner port wherein said outer port is disposed closer to an outer edge of said panel than said inner port and wherein said inner port has an opening on a suction side which is directed towards said second port.

33. The apparatus of claim 32, wherein said panel is releasably attached to said suction chamber.

34. The apparatus of claim 33, wherein the inner port is spaced apart from said outer port by at least the distance of the opening width of said inner port.

35. The apparatus of claim 16, wherein said suction chamber includes a panel disposed opposite to said second port and said first port further includes an outer port and an inner port wherein said outer port is disposed closer to an outer edge of said panel than said inner port and wherein said inner port has an opening on a suction side which is directed towards said second port.

36. The apparatus of claim 35, wherein said panel is releasably attached to said suction chamber.

37. The apparatus of claim 36, wherein the inner port is spaced apart from said outer port by at least the distance of the opening width of said inner port.

* * * * *